United States Patent [19]

Oushiden et al.

[11] Patent Number: 4,903,077

[45] Date of Patent: Feb. 20, 1990

[54] ELECTRONIC COPYING APPARATUS WITH TRIMMING FUNCTION

[75] Inventors: Hideshi Oushiden, Kawasaki; Norio Imada, Tokyo, both of Japan

[73] Assignee: Kabushiki Kaisha Toshiba, Kawasaki, Japan

[21] Appl. No.: 213,708

[22] Filed: Jun. 27, 1988

[30] Foreign Application Priority Data

Jun. 30, 1987 [JP] Japan ..... 62-162893

[51] Int. Cl.[4] ..... G03G 15/00

[52] U.S. Cl. ..... 355/204; 355/218; 355/244

[58] Field of Search ..... 355/7, 3 R, 14 R, 204, 355/206, 207, 208, 218, 244

[56] References Cited

U.S. PATENT DOCUMENTS

| | | | |
|---|---|---|---|
| 4,655,580 | 4/1987 | Watanabe et al. | 355/7 |
| 4,666,288 | 5/1987 | Watanabe | 355/14 R |
| 4,707,109 | 11/1987 | Kanno et al. | 355/7 |
| 4,777,510 | 10/1988 | Russel | 355/7 |
| 4,794,421 | 12/1988 | Stoudt et al. | 355/3 R |

*Primary Examiner*—A. C. Prescott

*Attorney, Agent, or Firm*—Foley & Lardner, Schwartz, Jeffery, Schwaab, Mack, Blumenthal & Evans

[57] ABSTRACT

An erasure portion designation section designates position data corresponding to an arbitrary portion to be erased, which is not required to be copied, of the original placed on the original table. A memory stores the position data of the portion to be erased designated by the erasure portion designation section. The position data is stored in units of originals for a plurality of originals. A readout designation section designates the position data, corresponding to the portion to be copied of a plurality of originals stored in the memory, to be read out in correspondence with the original to be copied. An original scanning section optically scans the original to be copied placed on the original table to obtain an optical image. An image forming section receives the optical image obtained by the original scanning section and transfers an image corresponding to the optical image onto an image recording medium. An image erasure section receives the position data of the portion to be erased read out from the memory by the readout designation section and erases a corresponding portion of the image to be formed by the image forming section.

11 Claims, 9 Drawing Sheets

ELECTRONIC COPYING APPARATUS WITH TRIMMING FUNCTION

BACKGROUND OF THE INVENTION

1. Field of the Invention

This invention relates to an electronic copying apparatus with a trimming function and, more particularly, to an image forming apparatus which is applied to an electronic copying machine which allows nonformation of an image within a designated area of an original image.

2. Description of the Related Art

As is well known, recently develope electronic copying machines have multifunctions, and can copy only a desired portion of an original image or a portion other than the designated portion by a trimming function.

In a copying machine of this type, a given portion of an original image can be arbitrarily designated as a nonformation region. A pattern of the designated nonformation region is stored in, e.g., a memory, so that this pattern can be utilized when another original image having an identical nonformation region is copied.

However, the above copying machine cannot store image nonformation region patterns for a plurality of originals. For this reason, each time a pattern other than the stored pattern is to be used as a nonformation region, a designation operation of the nonformation region must be performed, resulting in poor operability.

SUMMARY OF THE INVENTION

It is, therefore, an object of the present invention to provide a new and improved electronic copying apparatus with a trimming function which can eliminate a conventional drawback that each time a pattern other than a stored pattern is to be used as a non-formation region, a designation operation of the nonformation region must be performed, and which can facilitate designation operation of a nonformation region, thus shortening operation time and improving operability.

According to the present invention, there is provided a copying apparatus comprising:

means for generating data representing an image formation region in units of originals;

means for storing the data generated by the generating means;

means for reading out data stored by the storing means in accordance with the image formation region corresponding to each of the originals; and means for forming an image corresponding to each original within the image formation region in accordance with the data read out by the read out means.

BRIEF DESCRIPTION OF THE DRAWINGS

This and other objects and features of the present invention can be understood through the following embodiment by reference to the accompanying drawings, in which:

FIGS. 5 and 6 show a copying machine to which the present invention is applied, in which FIG. 5 is a perspective view showing the outer appearance of the copying machine, and FIG. 6 is a side sectional view of the copying machine;

FIGS. 10 to 12 show display examples on a display, in which

FIG. 10 is a view for explaining a memory mode display,

FIG. 11 is a view for explaining an area designation mode display, and

FIG. 12 is a view for explaining an area monitor display.

DETAILED DESCRIPTION OF THE PREFERRED EMBODIMENTS

An embodiment of the present invention will be described with reference to the accompanying drawings.

Figure 5:
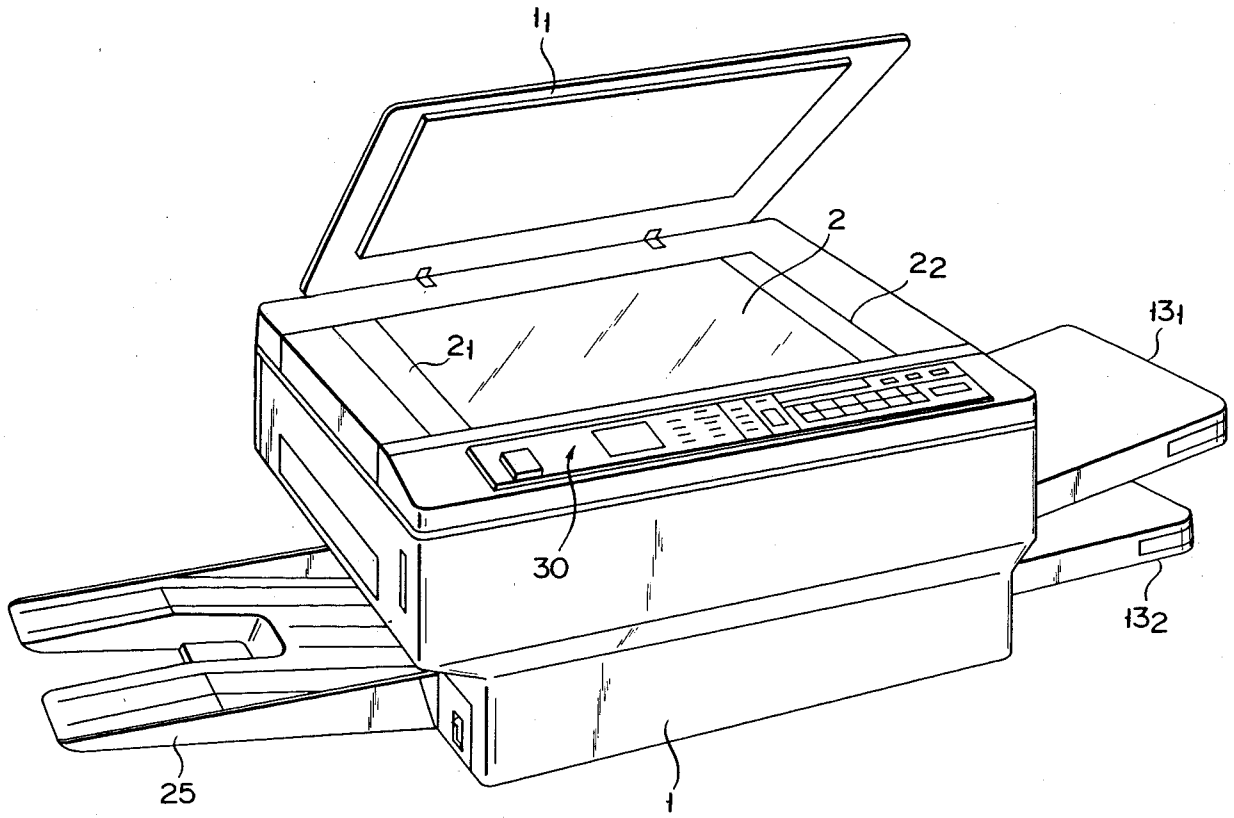
Figure 6:
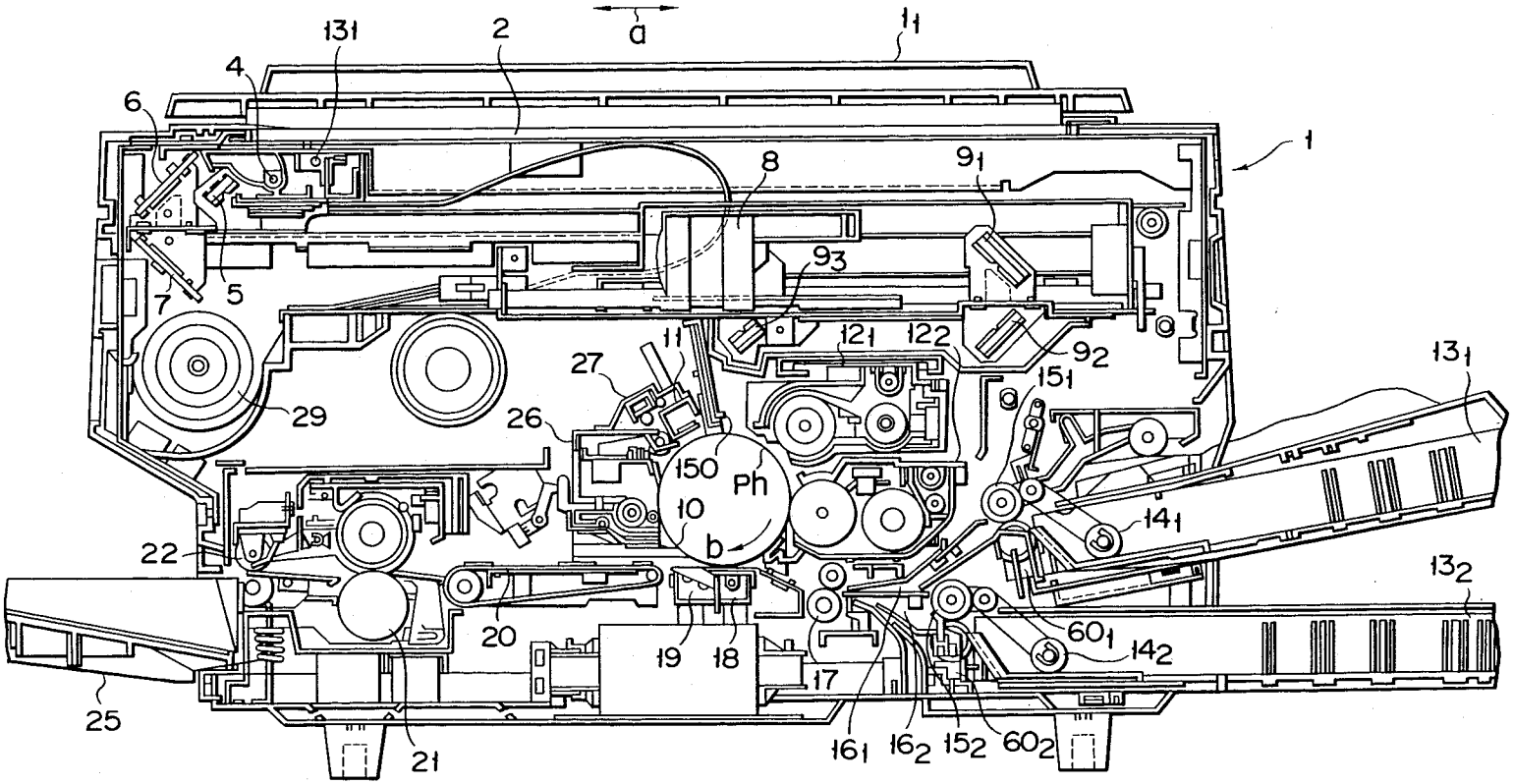

FIGS. 5 and 6 schematically show an image forming apparatus of the present invention, e.g., a copying machine. More specifically, reference numeral 1 denotes a copying machine main body. Original table (transparent glass) 2 for supporting an original is fixed on the upper surface of main body 1. Stationary scales $2_1$ and $2_2$ are disposed at two end portions of original table 2. Openable/closable original cover $1_1$ is mounted near original table 2.

An original placed on original table 2 is exposed and scanned when an optical system constituted by exposure lamp 4 and mirrors 5, 6, and 7 reciprocally moves in the direction of double-headed arrow a along the lower surface of original table 2. In this case, mirrors 6 and 7 are moved at a speed half that of mirror 5 so as to maintain a given optical path length. Light reflected from an original upon scanning by the optical system, i.e., light emitted from exposure lamp 4 and reflected by the original, is reflected by mirrors 5, 6, and 7, and then passes through variable magnification lens block 8. Thereafter, the light is reflected by mirrors $9_1$, $9_2$, and $9_3$, and is guided to photosensitive drum 10. Thus, the image of the original is formed on the surface of drum 10.

Drum 10 is rotated in the direction of arrow b, and its surface is charged by charger 11. Thereafter, an image is slit-exposed on the charged surface of drum 10, thereby forming an electrostatic latent image thereon. The latent image is developed to be visible by toner supplied from developers $12_1$ and $12_2$ which store a red or black toner, and are selectively operated as needed. Developers $12_1$ and $12_2$ are detachably arranged on main body 1. The toner color stored in developer $12_1$ or $12_2$ can be determined such that a color code as a combination of projections (not shown) formed on the side surface of developer $12_1$ or $12_2$ is detected by a color detection switch including a plurality of microswitches.

Paper sheets as recording material are picked up one by one from either selected upper or lower paper feed cassette $13_1$ or $13_2$ by either pickup roller $14_1$ or $14_2$ and roller pair $15_1$ or $15_2$. Each of the paper sheets is guided to register roller pair 17 through either paper guide path $16_1$ or $16_2$, and is fed to a transfer section by register roller pair 17. Paper feed cassettes $13_1$ and $13_2$ are detachably arranged on the right lower end portion of main body 1 and can be operated by selecting one of those at an operation panel (to be described later). Note that a paper size for cassette $13_1$ and $13_2$ is detected in accordance with their cassette size by cassette size detection switches $60_1$ and $60_2$ respectively. Each of cassette size detection switches $60_1$ and $60_2$ comprises a plurality of microswitches which are selectively turned on/off upon insertion of different size cassettes.

The paper sheet fed to the transfer section is brought into tight contact with the surface of drum 10 at a portion of transfer charger 18, so that a toner image on drum 10 is transferred to the sheet upon operation of charger 18. The sheet onto which the toner image was transferred is electrostatically peeled away from drum 10 by peeling charger 19, and is conveyed along conveyor belt 20 to fixing pair roller 21. The sheet is then fed into fixing roller pair 21 serving as a fixing device arranged at the trailing end portion of belt 20. The sheet having the fixed image thereon is then exhausted on tray 25 outside main body 1 by exhaust roller pair 22.

The residual toner on the surface of drum 10 which was subjected to the transfer operation is removed by cleaner 26, and an after-image on the surface of drum 10 is erased by discharging lamp 27, thus returning drum 10 to its initial state. Note that reference numeral 29 denotes a cooling fan for preventing the temperature in main body 1 from increasing.

Figure 7:
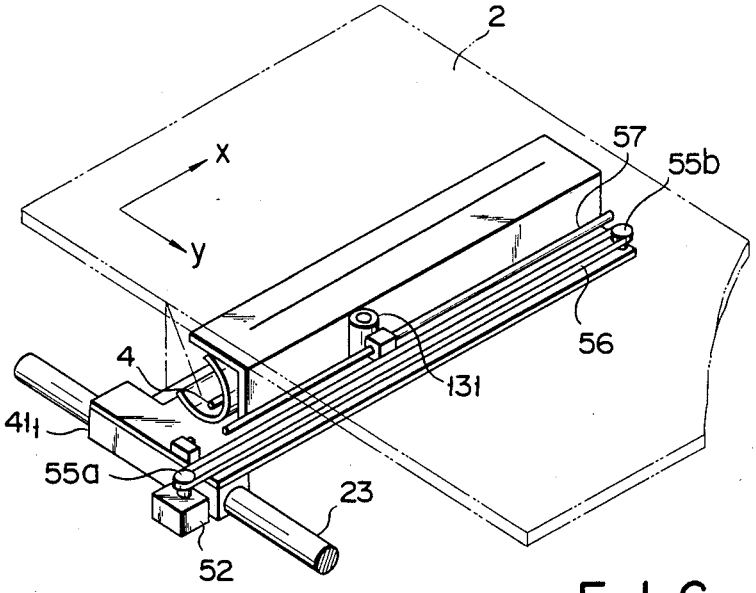
FIG. 7 is a perspective view schematically showing an arrangement of a carriage on which a spot light source and the like are mounted.
Figure 8:
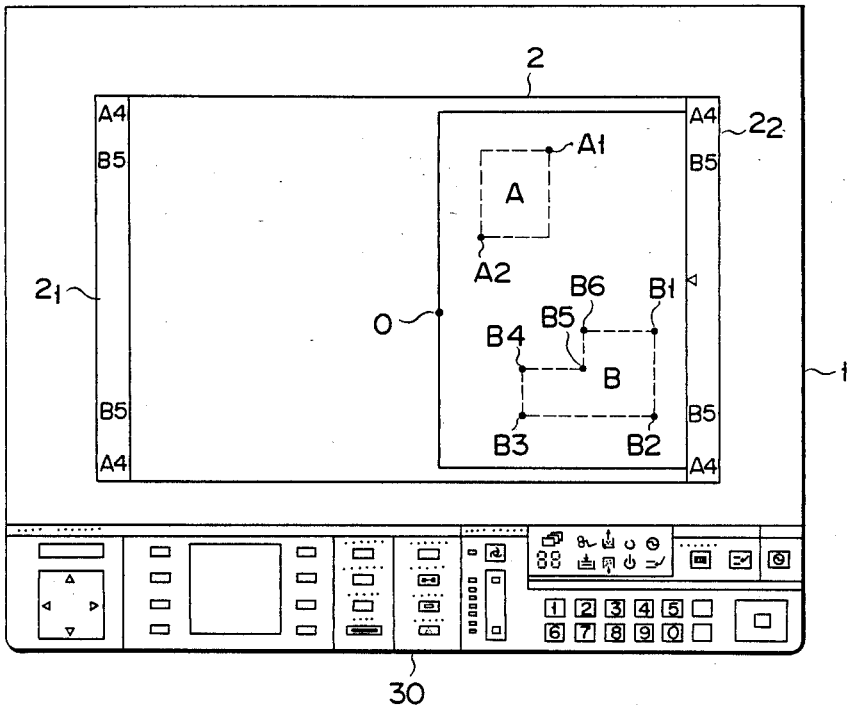
FIG. 8 is a view for explaining a designation operation of an erasure area.

Spot light source 131 is movably mounted on carriage $41_1'$ on which exposure lamp 4, and the like are disposed. Spot light source 131 is movable in a direction (direction of arrow x in FIG. 7) perpendicular to the moving direction (direction of arrow y in FIG. 7) of carriage $41_1'$ as shown in FIG. 7. Spot light source 131 comprises a light-emitting element for radiating a light spot on original table 2. In this case, carriage $41_1$ is movable in the direction of arrow y along shaft 23 by a drive mechanism (not shown), and spot light source 131 is movable in a direction of arrow x in FIG. 7 along shaft 57 by belt 56 looped between pulleys **55*a* and 55*b*. Pulley 55*a* is driven by motor 52. With this arrangement, as shown in FIG. 8**, given portion A, as an erasure area (image nonformation region), on original 0 can be arbitrarily designated by designating two points $A_1$ and $A_2$ or six points $B_1$, $B_2$, $B_3$, $B_4$, $B_5$, and $B_6$.

As shown in FIG. 6, erasure array 150 in which a plurality of light-emitting elements are arrayed is mounted between charger 11 and an exposure section of drum 10. When an original image is to be partially erased, the light-emitting elements constituting erasure array 150 are turned on in correspondence with an erasure area designated by, e.g., spot light source 131, thereby partially discharging drum 10. When the discharged portion is exposed by the exposure section, no latent image is formed thereon. As a result, the original image can be partially erased.

Figure 9:
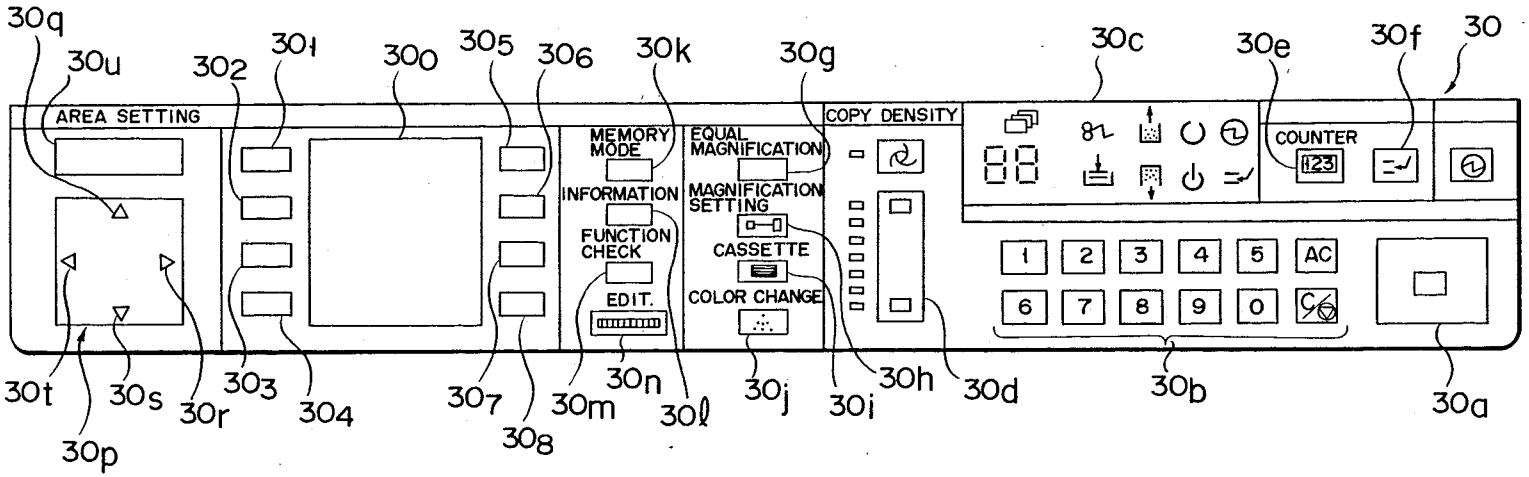
FIG. 9 is a plan view showing an arrangement of an operation panel.

FIG. 9 shows operation panel 30 mounted on main body 1. Reference numeral **30*a* denotes a copying key for instructing start of a copying operation; 30*b*, ten keys for setting a copy count and the like; 30*c*, a display section for displaying operating states of respective sections, paper jam, and the like; 30*d*, a density setting section for setting a copying density; 30*e*, a count instruction key for instructing display of a total copy count and a copy count for each color; 30*f*, an interrupt key operated when a third party wants to copy during a copying operation; 30*g*, an equal-magnification key operated when a copying magnification is set at an equal magnification (100%); 30*h*, a magnification key operated when a copying magnification is set; 30*i*, a cassette selection key operated when upper or lower cassette $13_1$ or $13_2$ is selected; and 30*j***, a color change key operated when the color of toner is changed to perform a copying operation.

Reference numeral **30*k* denotes a mode memory key. For example, when edit key 30*n* is operated to designate an erasure area of original 0, mode memory key 30*k* is operated so as to store the designated erasure area in a storage device (to be described later) or to read out, from the storage device, information such as an erasure area (nonformation region pattern for an original image) stored in the storage device. Reference numeral 30*l* denotes an information key operated when information corresponding to each mode is to be obtained. For example, when paper jam occurs and key 30*l* is operated, information for a paper jam state is displayed on display 30*o*. Reference numeral 30*m* denotes a function check key. When key 30*m* is operated, a currently set function can displayed on display 30*o*. Reference numeral 30*p* denotes a move key for moving spot light source 131. Move key 30*p* can be inclined in four directions as indicated by arrows 30*q* to 30*t*. When one of arrows 30*q* to 30*t* is operated, spot light source 131 is moved in the direction of the operated arrow. Reference numeral 30*u* denotes a position designation key. When key 30*u* is operated, a coordinate position indicated by spot light source 131** is stored in a memory (to be described later).

Edit key **30*n*** is operated when a partial erasure operation for copying an original image while erasing its given portion or a multicolor copying operation for copying an original image while changing the color of a designated portion is performed.

Display **30*o* comprises, e.g., a liquid-crystal dot matrix panel. Display 30*o* performs a corresponding display when edit key 30*n* or the like is operated. Operation keys $30_1$ to $30_4$ and $30_5$ to $30_8$ for selecting various functions displayed on display 30*o* are arranged at two side portions of display 30*o***.

Displays provided on display **30*o* of operation panel 30** will be described below.

Figure 10:
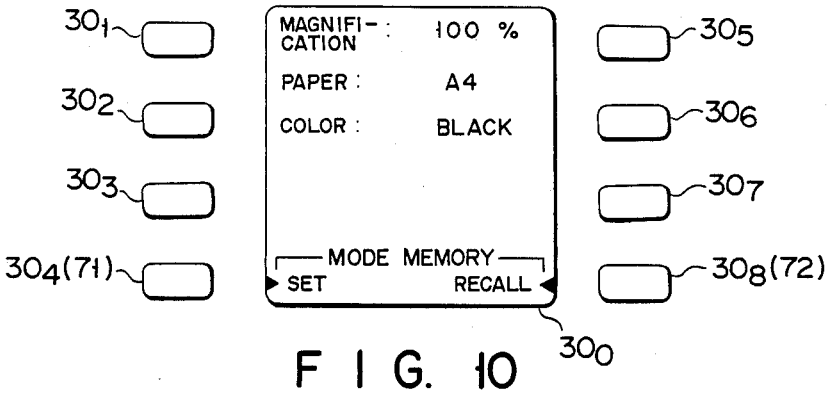

For example, when mode memory key **30*k* of operation panel 30 is operated, various currently set data, e.g., current copying magnification "100%", paper size "A4", toner color "black", and "mode memory set" and "recall" of an erasure area to and from the storage device, are displayed on display 30*o* of operation panel 30, as shown in FIG. 10. In this case, operation key $30_4$ serves as memory set key 71, and operation key $30_8$ serves as memory recall key 72. When one of ten keys 30*b* is operated while operating memory set key 71 (operation key $30_4$) in the memory mode, the content (erasure area) of the memory is transferred and stored in the storage area of the storage device designated by the operated ten key 30*b*. When one of ten keys 30*b* is operated while operating memory recall key 72 (operation key 308) in the memory mode, the erasure area stored in the storage area of the storage device designated by the operated ten key 30*b*** is recalled to the memory.

Figure 11:
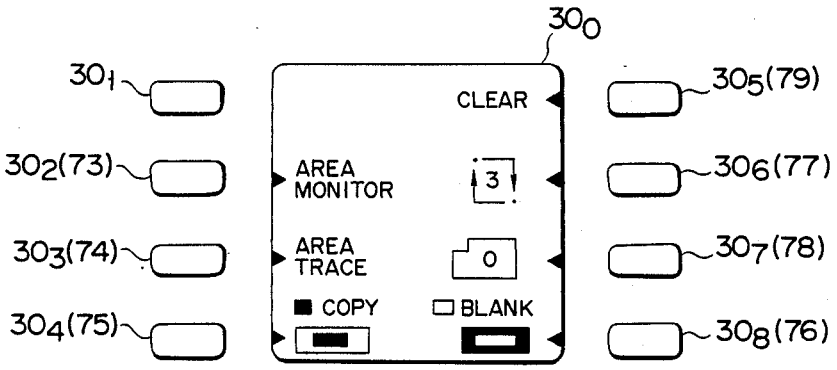

When edit key **30*n* is operated, the display on display 30*o* is updated to the state shown in FIG. 11. In this case, operation key $30_6$ serves as two-point designation key 77 having a function of designating points (two points) to designate a desired area of an original. When two-point designation key 77 (operation key $30_6$) is operated, a desired portion of an original can be designated using spot light source 131. A maximum of 6 areas of an original can be designated in this area designation mode, and the number of designated areas is numerically displayed in the display. Operation key $30_7$ serves as 6-point designation key 78 having a function of designating points at corners (6 points) to designate a desired area of an original. When 6-point designation key 78 (operation key $30_7$) is operated, a desired portion of an original can be designated using spot light source 131. A maximum of 2 areas of an original can be designated in this area designation mode, and the number of designated areas is numerically displayed in the display. Operation key $30_5$ serves as clear key 79** for clearing a designated area of an original image in the area designation mode or an erasure area stored in the memory.

Figure 12:
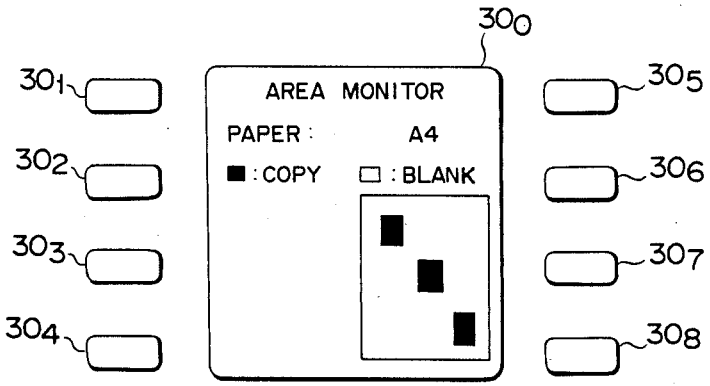

Operation key $30_4$ serves as trimming designation 75 for setting a trimming function, and operation key $30_8$ serves as masking designation key 76 for setting a masking function. Operation key $30_3$ serves as trace key 74 for setting a trace function of tracing an erasure area stored in the memory. When the trace function is set by key 74, ON spot light source 131 is moved along the frame of the erasure area in accordance with the erasure area. Operation key $30_2$ serves as monitor key 73 for setting a monitor function of monitoring an erasure area stored in the memory. When monitor key 73 (operation key $30_2$) is operated, the display content on display **30*o* is altered as shown in FIG. 12 while key 73** is kept on, so that the positions, number, size, shape, and the like of erasure areas stored in the memory are pattern-displayed.

Figure 1:
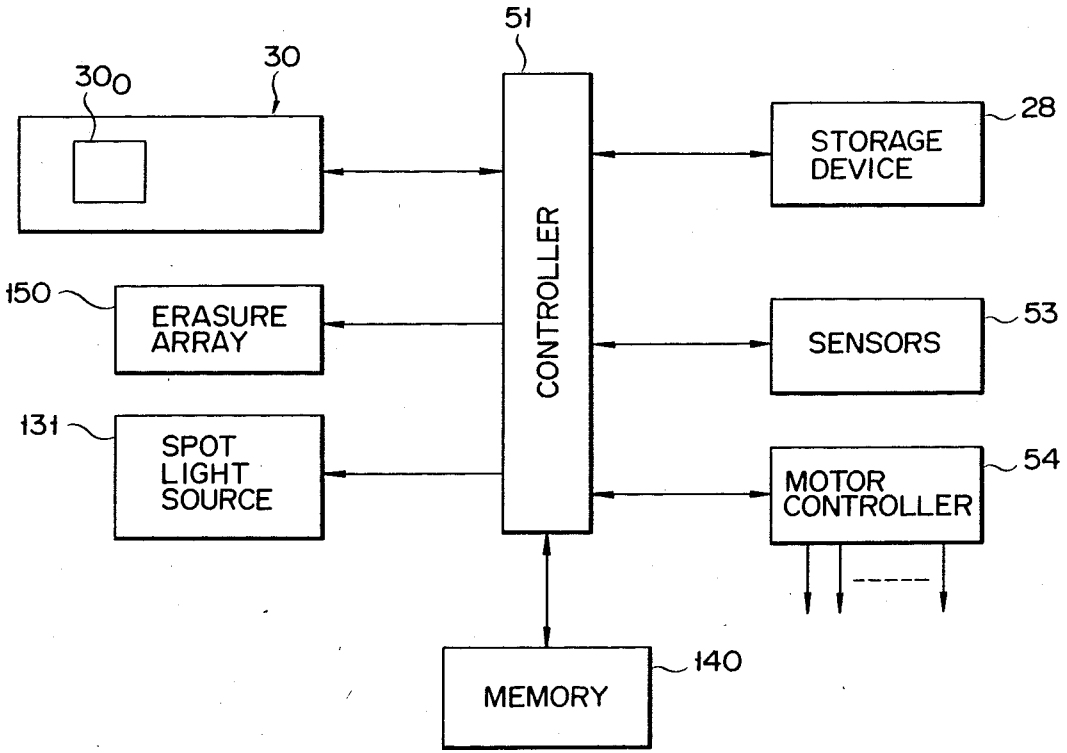
FIG. 1 is a block diagram showing the overall control circuit of a copying machine according to an embodiment of the present invention.

FIG. 1 shows the overall control circuit. Controller 51 detects inputs from operation panel 30, and various sensors 53 such as color detection switches for detecting colors of toner stored in developers $12_1$ and $12_2$, cassette size detection switches $60_1$ and $60_2'$ and the like, and controls the chargers (not shown), discharging lamp 27, cleaner 26, fixing roller pair 21, exposure lamp 4, and motor controller 54 connected to various motors (not shown) to perform the above-mentioned copying operation. Controller 51 also controls spot light source 131, memory 140, erasure array 150, and the like to perform a partial copying operation for copying an original image while erasing an unnecessary portion of the original, a multicolor copying operation for copying an original while changing a color of a designated portion, and the like.

Memory 140 comprises a RAM (Random Access Memory), or the like. For example, when position designation key **30*u* is operated in the erasure area designation mode, memory 140 stores coordinate positions (image erasure area) indicated by spot light source 131**.

Figure 2:
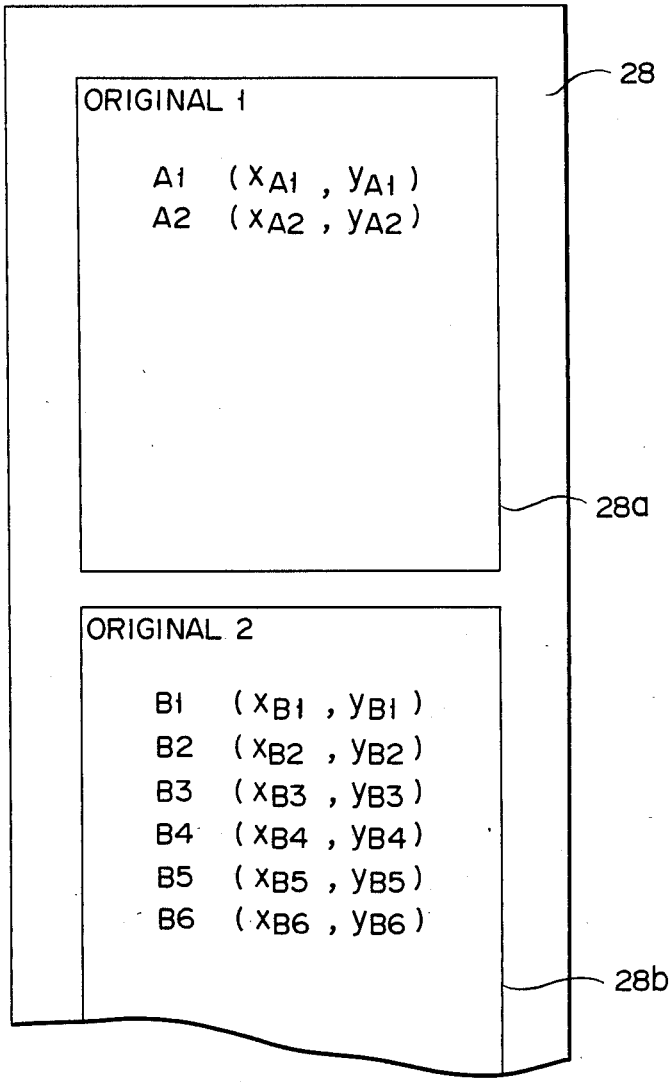
FIG. 2 is a schematic view showing an area format of a storage device.

Storage device 28 comprises, e.g., a battery-backup RAM. As shown in FIG. 2, storage device 28 includes a plurality of storage areas **28*a*, 28*b*, . . . which store designated erasure areas in units of originals. When memory set key 71 and ten key 30*b* are operated in the memory mode set upon operation of mode memory 30*k*, storage areas 28*a*, 28*b*, . . . designated by the corresponding ten keys 30*b* store the erasure areas in units of originals. For this reason, storage device 28** can store ten types of patterns representing erasure areas of images for 0 to 9 originals.

The operation of the above arrangement will be described below.

Figure 3:
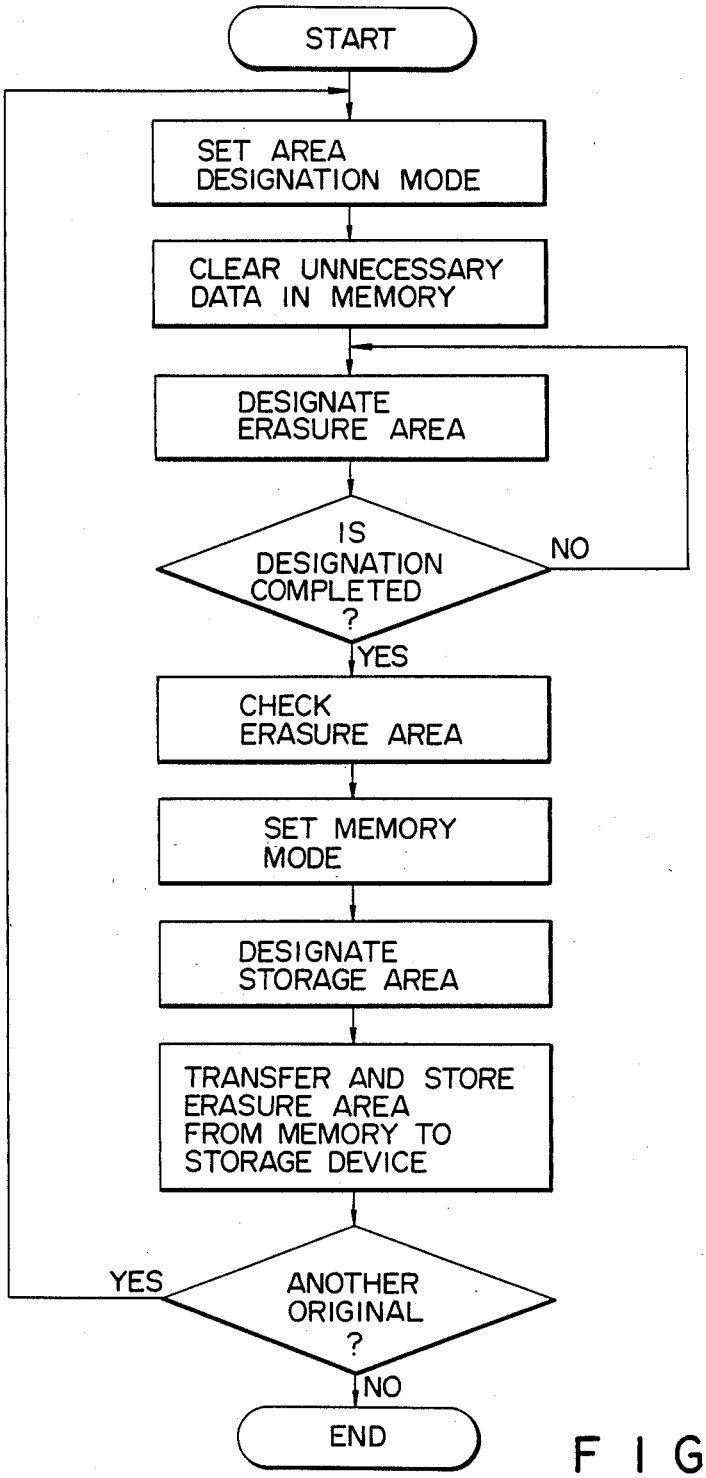
FIG. 3 is a flow chart for explaining an operation sequence when an erasure area is designated and stored.

An operation for designating an erasure area of an original image and causing the storage device to store the designated erasure area will be described with reference to the flow chart shown in FIG. 3. Assume that edit key **30*n* on operation panel 30 is operated. The area designation mode for designating an erasure area is then set, and the data shown in FIG. 11 are displayed on display 30*o* of operation panel 30. In this state, when clear key 79 (operation key $30_5$) is operated, unnecessary data left in memory 140** can be cleared.

After the clear operation, or when memory 140 need not be cleared, two-point designation key 77 (operation key $30_6$) or six-point designation key 78 (operation key $30_7$) is selectively operated to select a function of a desired area on original 0. When move key **30*p* on operation panel 30 is operated in accordance with the selected function, spot light source 131 is moved along desired portion A or B of original 0, as shown in FIG. 8. When position designation key 30*u* is operated at an arbitrary position, the corresponding coordinate position is stored in memory 140**, thus completing designation of the erasure area of an image.

When designation of a required number of erasure areas of original 0 is completed, the designated erasure areas, i.e., the positions, the numbers, sizes, shapes, and the like of the designated erasure areas are confirmed in accordance with an operation of monitor key 73 (operation key $30_2$) or trace key 74 (operation key $30_3$). In this case, if the trace function is selected, spot light source 131 is moved along frames of designated erasure areas in the ON state, thus allowing confirmation of the positions, numbers, sizes, shapes, and the like of the areas. When the monitor function is selected, as shown in FIG. 12, the designated erasure areas are displayed on display 30, so that their positions, number, sizes, shapes, and the like can be confirmed.

Upon this confirmation, if no error is found from the designated erasure areas, mode memory key **30*k* is operated to store the data on display 30*o* shown in FIG. 10. When one of ten keys 30*b* is operated while operating memory set key 71 (operation key $30_4$), the erasure area stored In memory 140 is transferred to storage device 28, and is stored in the storage area designated by the operated ten key 30*b*. Thus, the erasure areas of images can be stored in storage areas of storage device 28** in units of originals.

In this manner, upon completion of the storage operation of the erasure areas into storage device 28, if designation and storage operations of erasure areas of another original are to be performed, the above operation is repeated. Thus, erasure areas of another original are stored in other storage areas of storage device 28. A total of 10 types of nonformation region patterns can be stored as the erasure areas of an original image. When designation and storage operations of erasure areas of all the originals are completed, the mode is canceled, thus completing the processing.

Figure 4:
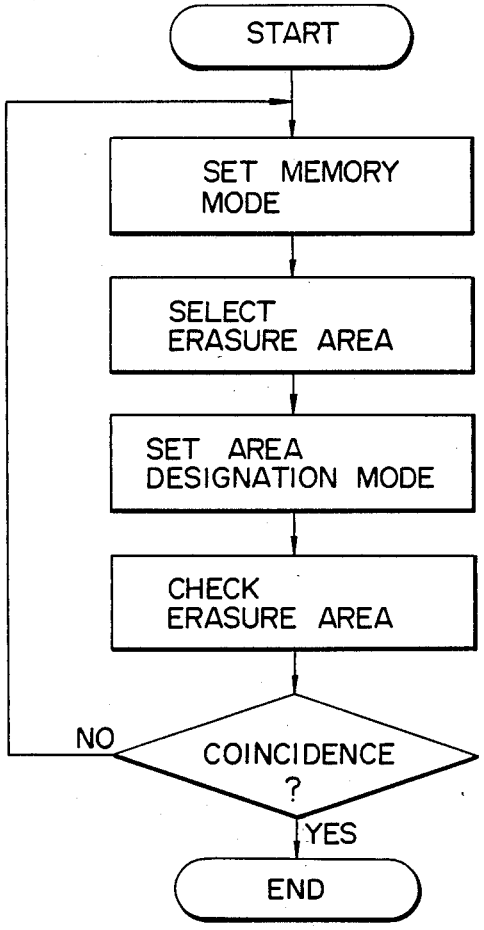
FIG. 4 is a flow chart for explaining an operation sequence when an erasure area is recalled.

An operation for reading out a desired erasure area from the storage device will be described with reference to the flow chart shown in FIG. 4. Assume that mode memory key **30*k* on operation panel 30 is operated. Thus, data indicating the memory mode is being set, i.e., data shown in FIG. 10 are displayed on display 30*o* of operation panel 30**.

In this state, when one of ten keys **30*b* corresponding to the storage area storing a desired erasure area is operated while operating memory recall key 72 (operation key $30_8$), the erasure area of an original stored in the storage area designated by the operated ten key 30*b* is transferred to and stored in memory 140. In this case, in accordance with the erasure area of an original to be copied, the erasure area stored in storage device 28** is read out.

Upon completion of the recalling operation of the erasure areas to memory 140, the display state on display **30*o* is altered, as shown in FIG. 11. In this area designation mode, the readout erasure area is confirmed, i.e., whether the position, number, size, shape, and the like of the erasure area read out from storage device 28 coincide with those of the erasure area of an original to be copied is checked in accordance with an operation of monitor key 73 (operation key $30_2$) or trace key 74** (operation key $30_3$).

If no error is found from the readout erasure area, trimming designation key 75 (operation key $30_4$) or masking designation key 76 (operation key $30_8$) is operated to select whether an image within or outside the erasure area of the original is to be copied. Thereafter, copying key **30*a*** is operated to perform the above-mentioned copying operation.

More specifically, when the trimming function is selected, erasure array 150 and the like are operated in accordance with copying conditions such as the copy count set by ten keys **30*b*, a density set by density setting section 30*d*, a magnification set by equal-magnification key 30*g* or magnification key 30*h*, a paper size set by cassette selection key 30*i*, a toner color set by color change key 30*j*, and the like, thus copying only an original image within the erasure area. When the masking function is selected, erasure array 150** and the like are operated in accordance with the copying conditions, so that only an original image outside the erasure area is copied.

As described above, since image nonformation region patterns for a plurality of originals can be stored, a variety of patterns can be stored in a storage means, and the nonformation region patterns stored therein can be utilized as nonformation regions of an original to be copied.

More specifically, when erasure areas for a plurality of originals are prestored, they can be utilized as those for performing a copying operation of only a similar designated portion or a copying operation of a portion excluding the designated portion. Thus, when an erasure area of an original to be copied does not coincide with that stored in the memory and it must be changed, an erasure area of another pattern can be read out from the storage device, and a copying operation can be easily started. Therefore, an inconvenience experienced when a designation operation of an erasure area must be designated each time an original is to be partially copied can be eliminated, and hence, an operation by a user can be facilitated. In addition, an operation time can be shortened.

In the above embodiment, storage areas are allocated in the storage device, and erasure areas of images are stored in units of originals. However, the present invention is not limited to this. For example, an erasure area may have an attribute indicating an original so as to be randomly stored. Not only an erasure area but also data for designating a trimming or masking function may be stored as well.

The above-mentioned function can be easily combined with a multicolor copying function.

The present invention is not limited to the above embodiment, and various other changes and modifications may be made within the spirit and scope of the invention.

According to the present invention as described above, an image forming apparatus which can simplify a designation operation of a nonformation region, and achieves improvement in operability such as a reduction in operation time, can be provided.

What is claimed is:

1. A copying apparatus comprising:

means for generating position data representing an image formation region in units of originals;

means for storing data generated by said generating means; said storing means including primary means for temporarily storing the position data, and secondary memory means for storing the position data transferred from different areas in said primary memory means in units of originals;

means for reading out the data stored by said storing means in accordance with the image formation region corresponding to each of the originals; and means for forming an image corresponding to each original within the image formation region in accordance with the data read out by said read out means.

2. An apparatus according to claim 1, wherein said secondary memory means includes nonvolatile memory means.

3. An electronic copying apparatus comprising:

an original table for placing thereon an original to be copied;

original scanning means for optically scanning the original to be copied placed on said original table to obtain an optical image;

image forming means for receiving the optical image obtained by said original scanning means and transferring an image corresponding to the optical image onto an image recording medium;

erasure portion designation means, for designating position data corresponding to at least an arbitrary portion to be erased, which is not required to be copied, of the original placed on said original table;

storage means for storing the position data of the portion to be erased designated by said erasure portion designation means, the position data being stored in units of originals for a plurality of originals;

readout designation means for designating the position data, corresponding to the portion to be erased of said plurality of originals stored in said storage means, and image erasure means for receiving the position data of the portion to be erased read out from said storage means by said readout designation means and erasing a corresponding portion of the image to be formed by said image forming means.

4. An apparatus according to claim 3, wherein said storage means comprises primary memory means for temporarily storing the position data, and secondary memory means for storing the position data transferred from different areas in said primary memory means in units of originals.

5. An apparatus according to claim 3, wherein said storage means includes nonvolatile memory means.

6. An apparatus according to claim 4, wherein said secondary memory means includes nonvolatile memory means.

7. An apparatus according to claim 3, wherein said erasure portion designation means includes transmission light means for movably providing transmission light on the original set on said original table, means for designating the position to be erased by the transmission light provided by said transmission light means, and means for calculating the position data of the portion to be erased designated by said transmission light designation means.

8. An apparatus according to claim 3, wherein said erasure portion designation means includes masking designation means for designating a region inside the designated portion as the region to be erased therein.

9. An apparatus according to claim 3, wherein said erasure portion designation means includes trimming designation means for designating a region outside the designated portion as the portion to be erased.

10. An apparatus according to claim 3, further comprising display means for displaying a content associated with the designation and storage operations of the portion to be erased.

11. An electronic copying apparatus comprising:

means for placing thereon an original to be copied;

original scanning means for optically scanning the original to be copied, said original being placed on said placing means to obtain an optical image;

image forming means for receiving the optical image obtained by said scanning means and transferring an image corresponding to the optical image onto an image recording medium;

erasure pattern designation means for designating erase pattern data including at least an arbitrary portion to be erased, which is not required to be copied, of each of a plurality of originals to be copied;

means for storing a plurality of said erase pattern data of said plurality of originals to be copied, which are designated by said erasure pattern designation means;

readout designation means for designating the erase pattern data of said plurality of originals stored in said storing means, in accordance with the original to be copied; and image erasure means for receiving the erase pattern data read out from said storing means by said readout designation means and erasing a corresponding portion of the image obtained by said scanning means.

* * * * *